US007810422B2

(12) United States Patent
David et al.

(10) Patent No.: US 7,810,422 B2
(45) Date of Patent: Oct. 12, 2010

(54) PROTECTION DEVICE FOR AN OBSERVATION SCREEN OF A VEHICLE

(75) Inventors: Jean-Luc David, Chatenay-Malabry (FR); Michel Garnier, Guyancourt (FR); Olivier Germenot, Versailles (FR)

(73) Assignee: Nexter Systems, Roanne (FR)

( * ) Notice: Subject to any disclaimer, the term of this patent is extended or adjusted under 35 U.S.C. 154(b) by 0 days.

(21) Appl. No.: 12/068,727

(22) Filed: Feb. 11, 2008

(65) Prior Publication Data

US 2008/0190279 A1 Aug. 14, 2008

(30) Foreign Application Priority Data

Feb. 13, 2007 (FR) ..... 07.01010

(51) Int. Cl.
*F41H 7/02* (2006.01)

(52) U.S. Cl. ..... 89/36.08; 89/36.01; 89/36.07; 89/36.09

(58) Field of Classification Search ..... None
See application file for complete search history.

(56) References Cited

U.S. PATENT DOCUMENTS

| | | | | |
|---|---|---|---|---|
| 1,461,478 | A * | 7/1923 | Daniels | 296/95.1 |
| 1,462,127 | A * | 7/1923 | Sanders | 296/95.1 |
| 3,026,140 | A * | 3/1962 | Schutte | 296/89 |
| 3,855,898 | A * | 12/1974 | McDonald | 89/36.08 |
| 4,159,669 | A | 7/1979 | Jackson et al. | |
| 4,643,477 | A * | 2/1987 | Kovatch | 296/96.21 |
| 5,307,725 | A | 5/1994 | Desmond et al. | |
| 5,419,604 | A * | 5/1995 | Clark | 296/97.9 |
| 5,421,284 | A * | 6/1995 | Wardavoir | 114/361 |
| 5,576,508 | A * | 11/1996 | Korpi | 89/36.01 |
| 5,658,039 | A * | 8/1997 | Bennett | 296/180.5 |
| 5,954,384 | A * | 9/1999 | Jones | 296/95.1 |
| 6,161,605 | A * | 12/2000 | Pena | 160/90 |
| 6,588,705 | B1 * | 7/2003 | Frank | 244/118.5 |
| 6,647,857 | B1 * | 11/2003 | Newkirk | 89/36.08 |
| 6,708,595 | B1 * | 3/2004 | Chaussade et al. | 89/36.02 |
| 6,767,044 | B2 * | 7/2004 | Tohda et al. | 296/107.01 |
| 7,152,517 | B1 * | 12/2006 | Ivey | 89/36.01 |
| 7,178,476 | B1 * | 2/2007 | Belkov | 114/361 |
| 7,225,718 | B1 * | 6/2007 | Grove et al. | 89/36.09 |
| 7,475,928 | B1 * | 1/2009 | Clum et al. | 296/1.04 |
| 2004/0144243 | A1 * | 7/2004 | Newkirk | 89/36.01 |
| 2005/0210781 | A1 * | 9/2005 | Lawrence | 52/204.5 |
| 2008/0303308 | A1 * | 12/2008 | Hanson et al. | 296/146.16 |
| 2009/0044694 | A1 * | 2/2009 | Allor et al. | 89/36.08 |
| 2009/0044695 | A1 * | 2/2009 | Benjamin et al. | 89/36.08 |

FOREIGN PATENT DOCUMENTS

| | | | |
|---|---|---|---|
| DE | 26 25 789 | | 12/1977 |
| EP | 1 361 409 | A2 | 11/2003 |
| EP | 1361409 | A2 * | 11/2003 |

* cited by examiner

*Primary Examiner*—Troy Chambers
*Assistant Examiner*—Samir Abdosh
(74) *Attorney, Agent, or Firm*—Oliff & Berridge, PLC

(57) ABSTRACT

A protection device for an observation screen of a vehicle, wherein it is constituted by a plate of armor positioned outside of the vehicle, and pivoting arms ensuring the displacement of the armor plate from a passive position in which the field of vision is totally free and one or several protection positions.

16 Claims, 3 Drawing Sheets

PROTECTION DEVICE FOR AN OBSERVATION SCREEN OF A VEHICLE

BACKGROUND OF THE INVENTION

1. Field of the Invention

The technical scope of the present invention is that of devices to protect a vehicle, and more particularly, devices enabling the protection of an observation screen such as a windscreen or vehicle observation opening.

2. Description of the Related Art

Different devices applied to a windscreen are already known to protect the vehicle's occupants from an external aggression, such as by a projectile.

It is namely the case of U.S. Pat. No. 5,307,725 which discloses a windscreen protection device in the form of two pivotal sliding plates enabling the windscreen to be covered up. A major drawback to this system lies in the fact that it is located inside the vehicle, requiring a free space to be provided for its installation. Moreover, during its deployment, the protection plates run the risk of colliding with the driver's head, which is to be avoided.

Anti-riot vehicles are also known which incorporate a caged protection so as to protect the vehicle's windscreen from projectiles whilst ensuring that the driver's retains a certain amount of visibility. One drawback to this protection lies in the fact that it is ineffective with respect to projectiles of small size (for example, the bullet of a gun) or which have considerable inertia.

SUMMARY OF THE INVENTION

The aim of the present invention is to supply a protection device for the windscreen of a vehicle which does not suffer from such drawbacks.

The invention thus relates to a protection device for an observation screen of a vehicle, wherein it is constituted by a plate of armor positioned outside of the vehicle, and pivoting arms ensuring the displacement of the armor plate from a passive position in which the field of vision is totally free and one or several protection positions.

According to one characteristic of the invention, the passive position of the armor plate corresponds to a position of the plate against a side of the vehicle, and below or in front of the observation screen.

According to another characteristic of the invention, the armor plate may adopt several protection positions between the passive position and a fully protective position totally obscuring the observation screen.

According to yet another characteristic of the invention, the lower part of the plate cooperates with rails so as to be in constant contact with one side of the vehicle during any displacement of the plate.

According to another characteristic of the invention, the rails constitute a lateral protection of the observation screen.

According to another characteristic of the invention, the device incorporates a visor arranged above the observation screen, constituting upper protection for the screen and receiving the upper part of the armor plate when the latter fully obscures the observation screen.

According to another characteristic of the invention, the visor and the upper part of the armor plate incorporate matching profiles.

According to another characteristic of the invention, the device incorporates indirect viewing means.

A first advantage of the device according to the invention lies in the fact that it proposes means to protect a viewing screen able to provide several different levels of protection depending on the threat.

Another advantage lies in the facility of production and its low cost.

Another advantage of the device lies in the fact that it does not require any particular configuration of the vehicle to be equipped and may be mounted onto any type of vehicle.

Another advantage lies in the fact that the device is arranged outside of the vehicle.

BRIEF DESCRIPTION OF THE DRAWINGS

Other characteristics, particulars and advantages of the invention will become more apparent from the description given hereafter by way of illustration and in reference to the drawings, in which.

DETAILED DESCRIPTION OF PREFERRED EMBODIMENTS

Figure 1:
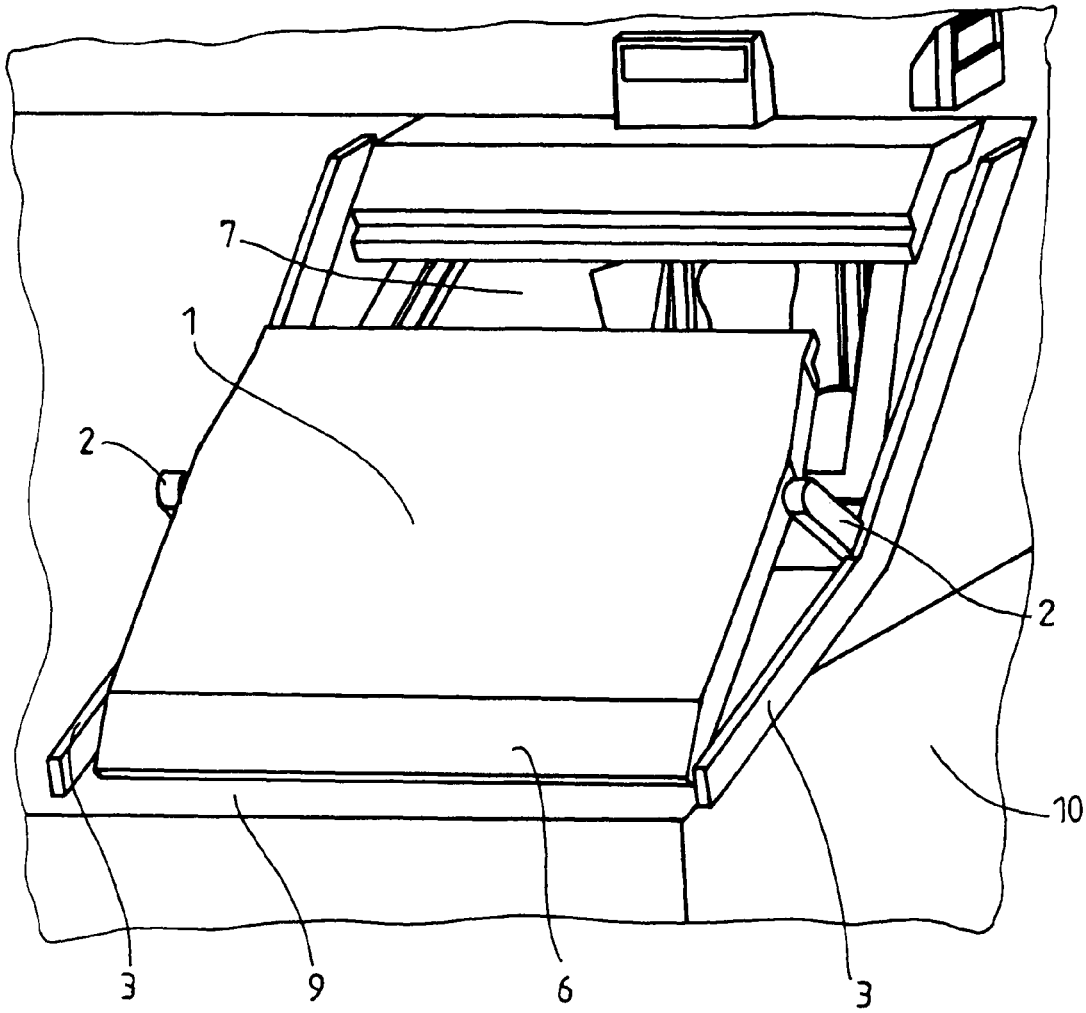
FIG. 1 shows a protection device for the observation screen of a vehicle according to the invention.

FIG. 1 shows a protection device for an observation screen of a vehicle according to the invention. In this embodiment, the observation screen 7 is the windscreen of a military vehicle. The windscreen protection device is made by a plate of armor 1 arranged outside of the vehicle and supported by pivoting arms 2. The pivoting arms 2 are linked to the vehicle body 10 by a pivot type link and to the armor plate 1 by pivots (or ball joints to ensure an isostatic assembly). Motor means (not shown) ensure the rotation of the arms 2 with respect to the body 10 of the vehicle. Rails 3 are arranged on either side of the protection plate 1 and match the profile of the external wall 9 (or glacis) of the vehicle. The lower part 6 of the armor plate cooperates with the rails 3 so as to be in constant contact with the external wall of the vehicle during the displacements of the plate. The rails 3 also constitute guidance means for the armor plate and a side protection for the observation screen 7. FIG. 1 shows the protection device in a position called "semi-protected". The device may naturally adopt other positions described with reference to FIGS. 2*a* to 2*d*.

FIGS. 2*a* to 2*d* show different positions of the protection device, according to the level of protection to be adopted, between a passive position which leaving the field of vision totally free, and a full protection position obscuring the observation screen 7.

Figure 2A:
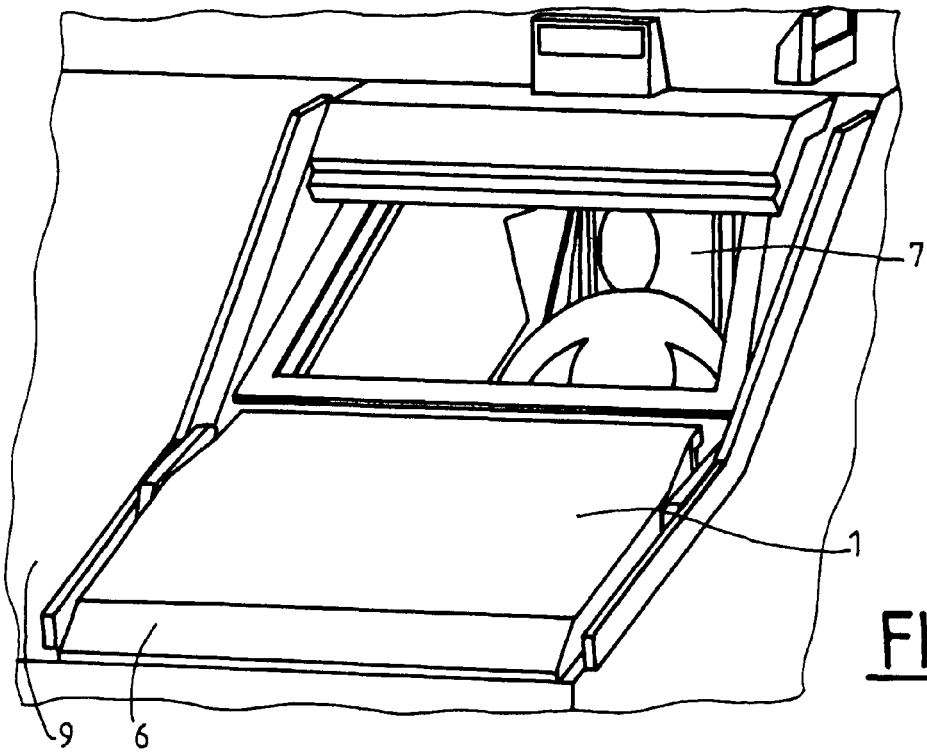
FIGS. 2*a* to 2*d* show different positions of the protection device depending on the level of protection required.

FIG. 2*a* illustrates the passive position of the armor plate 1. In this position, the plate 1 is arranged against the external wall 9 of the vehicle and in front of the observation screen 7. This position enables the observer located inside the vehicle to take advantage of a wide view of the external environment.

Figure 2B:
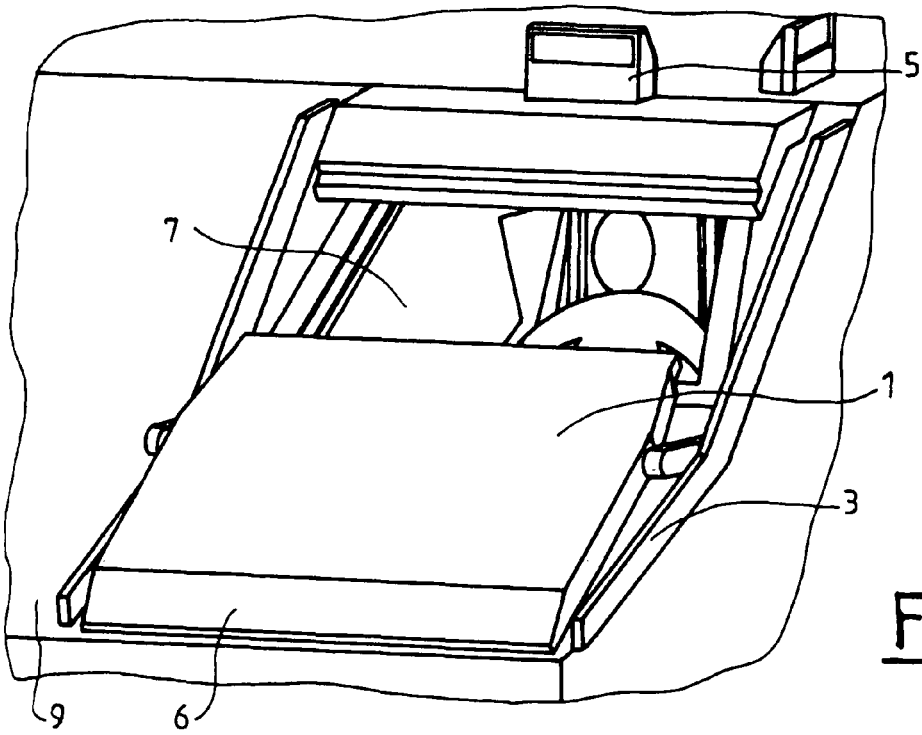
Figure 2C:
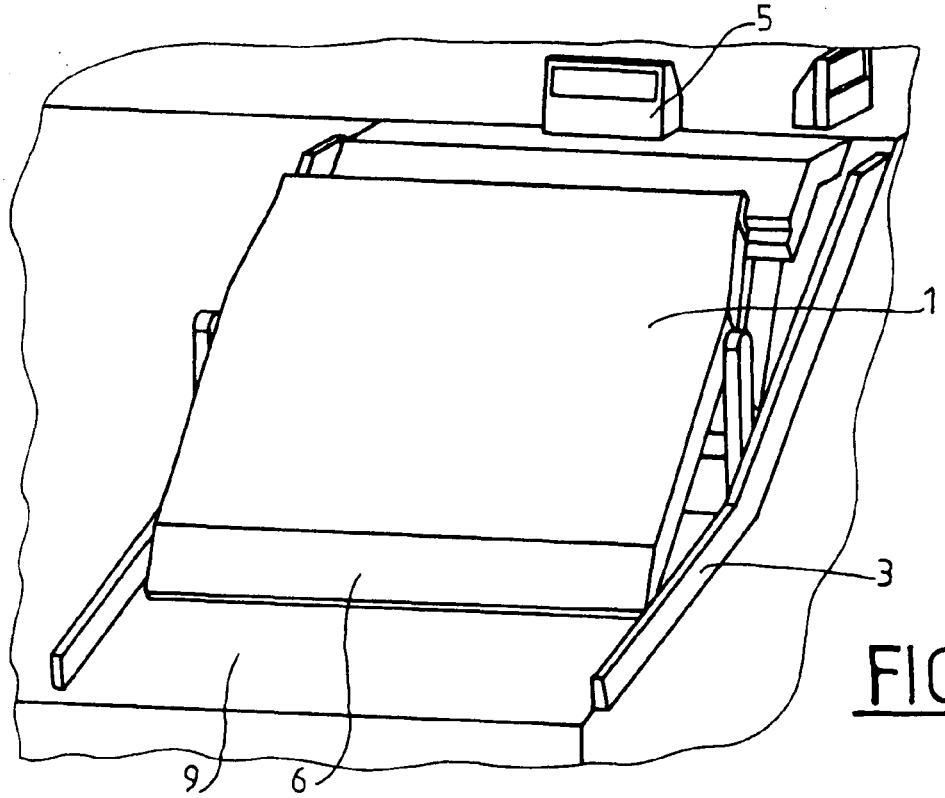

FIGS. 2*b* and 2*c* show intermediate positions. In these positions, the arms 2 driven in rotation by a motor (not shown) have made the armor plate 1 move into an intermediate position enabling the observer (or driver) to be protected from an attack (stones being thrown, ballistic projectile, etc) whilst retaining a minimal field of vision. Indirect viewing means 5, for example one or several episcopes (or one or several cameras), overcome the reduction in the field of vision. When the armor plate 1 is displaced, its lower part 6 cooperates with the rails 3 so as to be in constant contact with the external wall 9 of the vehicle.

Figure 2D:
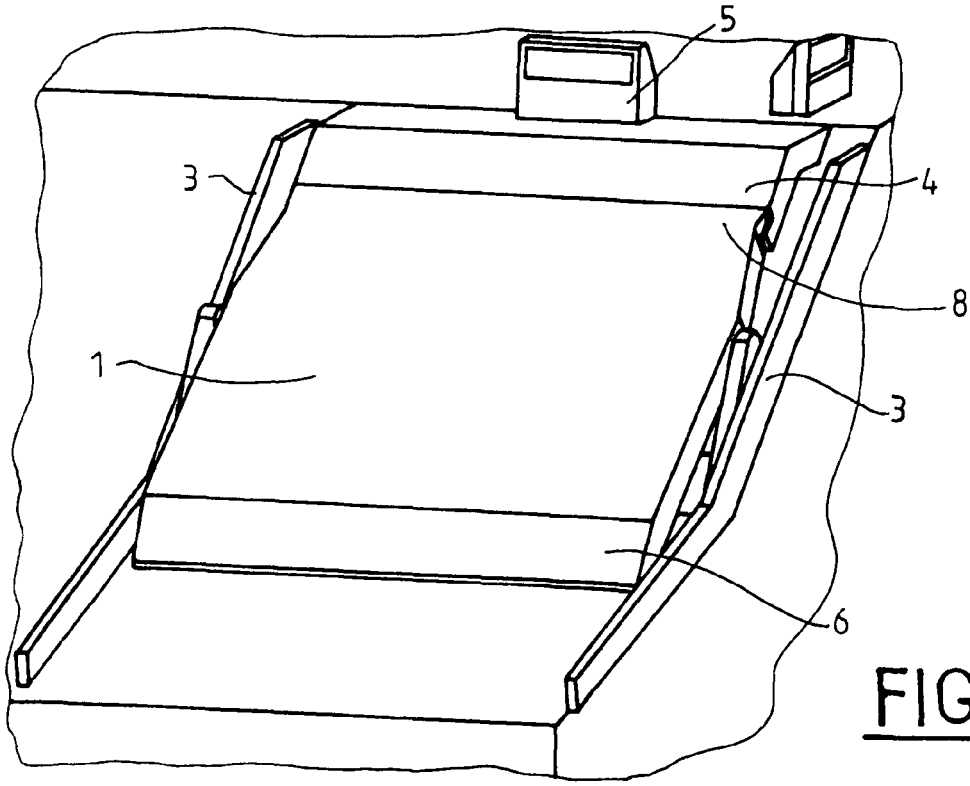

FIG. 2*d* shows the full protection position of the observation screen. In this position, the plate 1 is positioned so as to fully obscure the observation screen 7. A visor 4 is positioned above the observation screen 7 which receives the upper part 8 of the armor plate 1. Advantageously, the visor 4 and upper part 8 of the armor plate incorporate matching profiles. The visor 4 also constitutes an upper protection for the observation screen and the rails 3 a side protection. The visor 4 and well as the glacis 9 of the vehicle are dimensioned to withstand the stresses transmitted by the armor plate 1.

In this position, the observer (or the driver) only has indirect observation means to monitor the external environment.

The device operates as follows: in normal conditions, the vehicle is subject to no attacks, the plate 1 is positioned against the external wall 9 of the vehicle. When the vehicle is being attacked or is likely to be so, the driver, or the observer, activates the rotation of the arms 2, by means of a control (not shown) placed inside the vehicle. The rotation of the arms may be activated in one direction or another so as to position the armor plate 1 in the required protection position, depending on the threat. The armor plate is then held in position, until being displaced once again, into an upper or lower protection position.

The device according to the invention is shown here protecting the windscreen of a vehicle. Such a device may naturally be applied to other observation screens in a vehicle, for example to side windows or a rear hatch window.

What is claimed is:

1. A protection device for an observation screen of a vehicle, wherein the protection device comprises a plate of armor that is positioned at an outside of the vehicle and pivoting arms for moving the plate of armor between a passive position in which a field of vision of the observation screen is substantially or completely unobstructed and one or more protection positions, wherein the plate of armor has a first portion slidably attached to the vehicle so that the first portion of the plate of armor is capable of sliding along the vehicle and a second portion pivotably connected to the pivoting arms, and wherein the passive position of the plate of armor corresponds to a position of the plate of armor being against an external side of the vehicle that is below the observation screen.

2. A protection device for the observation screen of a vehicle according to claim 1, wherein the plate of armor can be disposed in several protective positions between the passive position and a fully protective position, the fully protective position substantially or completely obscuring the observation screen.

3. A protection device for the observation screen of a vehicle according to claim 1, wherein a lower part of the plate of armor cooperates with rails so that the lower part of the plate of armor is in constant contact with an external side of the vehicle during any displacement of the plate of armor.

4. A protection device for the observation screen of a vehicle according to claim 3, wherein the rails further comprise a lateral protection of the observation screen.

5. A protection device for the observation screen of a vehicle according to claim 1, wherein the protection device further comprises a visor that is disposed above the observation screen, the visor providing an upper protection for the observation screen and receiving an upper part of the plate of armor when the plate of armor is in a fully protective position, the fully protective position substantially or completely obscuring the observation screen.

6. A protection device for the observation screen of a vehicle according to claim 5, wherein the visor and the upper part of the plate of armor have matching profiles.

7. A protection device for the observation screen of a vehicle according to claim 1, wherein the protection device further comprises an indirect viewing means.

8. A protection device for the observation screen of a vehicle according to claim 1, wherein the observation screen comprises a windshield.

9. A protection device for an observation screen of a vehicle, comprising:

a plate of armor that is positioned outside of a passenger compartment of the vehicle, wherein the plate of armor has a first portion slidably attached to the vehicle so that the first portion of the plate of armor is capable of sliding along the vehicle and a second portion pivotably connected to pivoting arms;

wherein each of the pivoting arms has one end pivotably connected to the vehicle and the other end pivotably connected to the second portion of the plate of armor, and the pivoting arms are capable of pivoting the plate of armor between a passive position in which a field of vision of the observation screen is substantially or completely unobstructed and one or more protection positions that at least partially cover the observation screen from the outside of the passenger compartment.

10. A protection device for the observation screen of a vehicle according to claim 9, wherein the plate of armor can be disposed in several protective positions between the passive position and a fully protective position, the fully protective position substantially or completely covering the observation screen.

11. A protection device for the observation screen of a vehicle according to claim 9, wherein the first portion of the plate of armor cooperates with rails so that the first portion of the plate of armor is in constant contact with an external side of the vehicle during any displacement of the plate of armor.

12. A protection device for the observation screen of a vehicle according to claim 11, wherein the rails further comprise a lateral protection of the observation screen.

13. A protection device for the observation screen of a vehicle according to claim 9, wherein the protection device further comprises a visor that is disposed above the observation screen, the visor providing an upper protection for the observation screen and receiving an upper part of the plate of armor when the plate of armor is in a fully protective position, the fully protective position substantially or completely obscuring the observation screen.

14. A protection device for the observation screen of a vehicle according to claim 13, wherein the visor and the upper part of the plate of armor have matching profiles.

15. A protection device for the observation screen of a vehicle according to claim 9, wherein the protection device further comprises an indirect viewing means.

16. A protection device for the observation screen of a vehicle according to claim 9, wherein the observation screen comprises a windshield.

* * * * *